US008419472B1

(12) United States Patent
Swanger et al.

(10) Patent No.: US 8,419,472 B1
(45) Date of Patent: Apr. 16, 2013

(54) GROUNDING STRUCTURES FOR HEADER AND RECEPTACLE ASSEMBLIES

(75) Inventors: Nathan William Swanger, Mechanicsburg, PA (US); Charles S. Pickles, York, PA (US); Timothy Robert Minnick, Enola, PA (US); Justin Shane McClellan, Camp Hill, PA (US); Jeffrey Byron McClinton, Harrisburg, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/360,884

(22) Filed: Jan. 30, 2012

(51) Int. Cl.
*H01R 13/648* (2006.01)

(52) U.S. Cl.
USPC ..... 439/607.07

(58) Field of Classification Search ..... 439/607.07, 439/607.1, 607.11, 607.05, 607.06
See application file for complete search history.

(56) References Cited

U.S. PATENT DOCUMENTS

| | | | | |
|---|---|---|---|---|
| 6,814,619 | B1 * | 11/2004 | Stokoe et al. | 439/607.07 |
| 8,011,657 | B2 * | 9/2011 | Kiyosumi | 271/265.01 |
| 8,162,065 | B2 * | 4/2012 | Zupanick | 166/370 |
| 8,210,876 | B2 * | 7/2012 | Derks et al. | 439/607.06 |

* cited by examiner

*Primary Examiner* — Phuong Dinh

(57) ABSTRACT

A receptacle assembly includes a contact module that includes a conductive holder and a frame assembly received in the conductive holder. The frame assembly includes a plurality of contacts and a dielectric frame supporting the contacts and disposed between the conductive holder and the contacts. The contacts extend from the conductive holder for electrical termination. A front housing receives the contact module therein. The front housing has a plurality of clip supports at a rear of the front housing. A rib clip is held by the clip supports. The rib clip has a plurality of grounding fingers that extend therefrom that are configured to engage corresponding header shields of a header assembly. The rib clip includes a plurality of mounting tabs that extend therefrom for engaging the conductive holder to electrically connect the rib clip to the conductive holder.

20 Claims, 6 Drawing Sheets

GROUNDING STRUCTURES FOR HEADER AND RECEPTACLE ASSEMBLIES

BACKGROUND OF THE INVENTION

The subject matter herein relates generally to grounding structures in connector assemblies.

Electrical systems, such as those used in networking and telecommunication systems, utilize receptacle and header connectors to interconnect components of the system, such as a motherboard and daughtercard. However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact, such as at a point above a differential pair of signal contacts. Some known connectors provide side shielding along the sides of the differential pairs in the form of a folded-over ground tab on each side of the differential pair, which is implemented on the header connector as part of the ground contact of the header connector. However, known connector systems do not include a direct connection of the folded-over ground tabs to a side shield of the receptacle connector, which causes the folded-over ground tabs to act as resonating structures that cause crosstalk at higher frequency applications.

A need remains for an electrical system having improved shielding to meet particular performance demands.

BRIEF DESCRIPTION OF THE INVENTION

In one embodiment, a receptacle assembly is provided having a contact module that includes a conductive holder and a frame assembly received in the conductive holder. The frame assembly includes a plurality of contacts and a dielectric frame that support the contacts. The dielectric frame is disposed between the conductive holder and the contacts. The contacts extend from the conductive holder for electrical termination. A front housing is configured for mating with a header assembly. The front housing receives the contact module therein. The front housing has a plurality of clip supports at a rear of the front housing. A rib clip is held by the clip supports. The rib clip has a plurality of grounding fingers that extend therefrom and is configured to engage corresponding header shields of the header assembly. The rib clip includes a plurality of mounting tabs that extend therefrom. The mounting tabs engage the conductive holder to electrically connect the rib clip to the conductive holder.

In another embodiment, a receptacle assembly is provided having a first contact module that includes a conductive holder and a frame assembly received in the conductive holder. The frame assembly of the first contact module includes a plurality of contacts and a dielectric frame that support the contacts. The contacts extend from the conductive holder of the first contact module for electrical termination. A second contact module includes a conductive holder and a frame assembly received in the conductive holder. The frame assembly of the second contact module includes a plurality of contacts and a dielectric frame that support the contacts. The contacts extend from the conductive holder of the second contact module for electrical termination. A front housing is configured for mating with a header assembly. The front housing receives the first and second contact module therein with the first and second contact modules arranged in a stacked configuration in the front housing. The front housing has a plurality of clip supports at a rear of the front housing. A rib clip is held by the clip supports. The rib clip has a plurality of grounding fingers that extend therefrom and are configured to engage corresponding header shields of the header assembly. The rib clip includes a plurality of mounting tabs that extend therefrom. A first subset of the mounting tabs engages the conductive holder of the first contact module to electrically connect the rib clip to the conductive holder of the first contact module. A second subset of the mounting tabs engage the conductive holder of the second contact module to electrically connect the rib clip to the conductive holder of the second contact module.

In a further embodiment, an electrical connector assembly is provided having a header assembly that includes a header housing. A plurality of header contacts are held by the header housing, and a plurality of C-shaped header shields surround corresponding header contacts. The header shields have walls defining the C-shaped header shields. A receptacle assembly is matable to the header assembly. The receptacle assembly includes a first contact module that has a conductive holder and a frame assembly received in the conductive holder. The frame assembly of the first contact module includes a plurality of contacts and a dielectric frame that support the contacts. The contacts extend from the conductive holder of the first contact module for electrical termination. A second contact module includes a conductive holder and a frame assembly that are received in the conductive holder. The frame assembly of the second contact module includes a plurality of contacts and a dielectric frame supports the contacts. The contacts extend from the conductive holder of the second contact module for electrical termination. A front housing is configured for mating with the header housing. The front housing receives the first and second contact module therein with the first and second contact modules arranged in a stacked configuration in the front housing. The front housing has a plurality of clip supports at a rear of the front housing. A rib clip is held by the clip supports. The rib clip have a plurality of grounding fingers that extend therefrom and are configured to engage corresponding header shields of the header assembly. The rib clip includes a plurality of mounting tabs that extend therefrom. A first subset of the mounting tabs engage the conductive holder of the first contact module to electrically connect the rib clip to the conductive holder of the first contact module. A second subset of the mounting tabs engage the conductive holder of the second contact module to electrically connect the rib clip to the conductive holder of the second contact module.

DETAILED DESCRIPTION OF THE INVENTION

Figure 1:
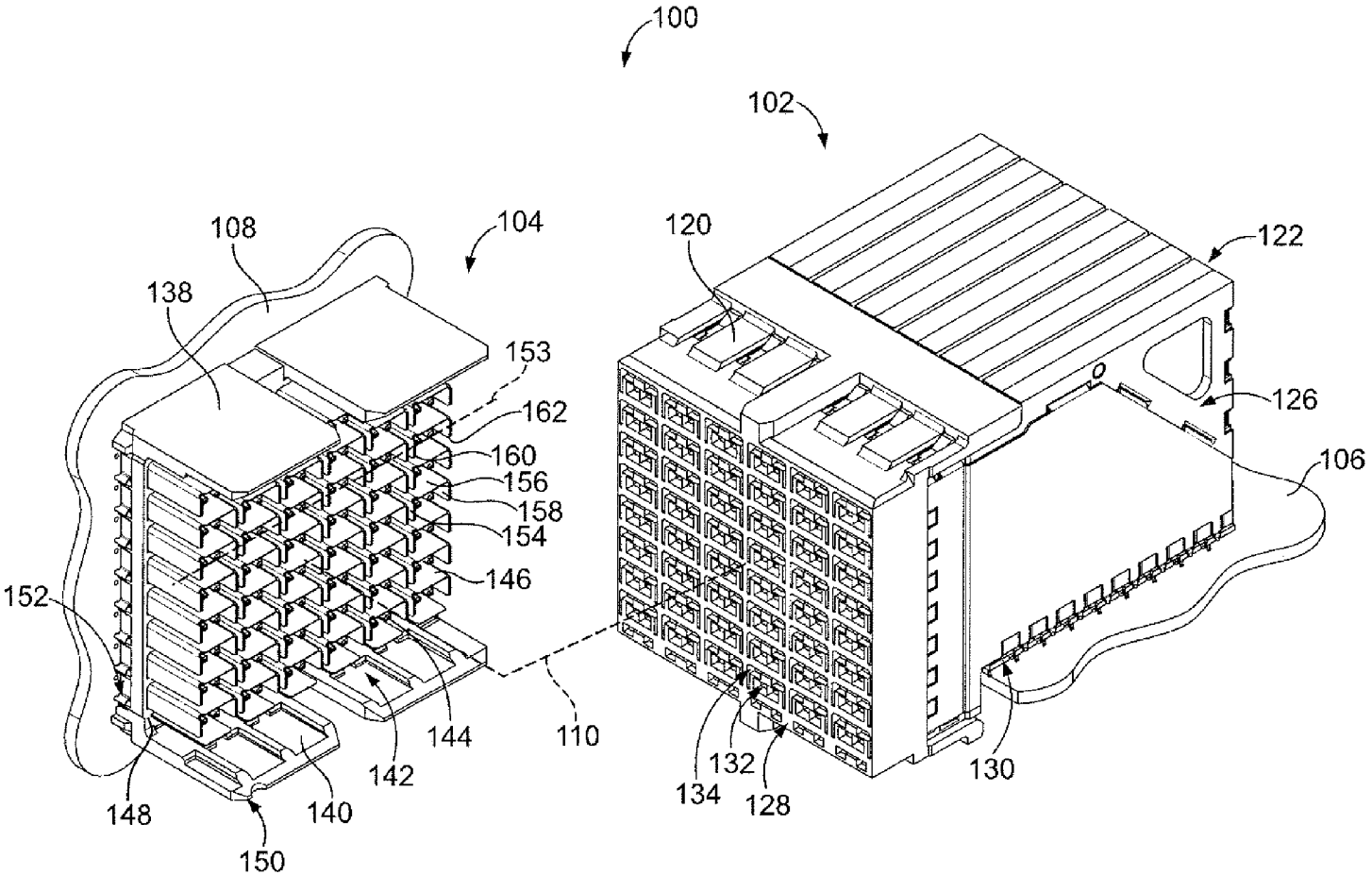
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. The shield structure 126 includes multiple components, electrically interconnected, which provide the electrical shielding. Optionally, the shield structure 126 may provide electrical shielding for differential pairs of the receptacle signal contacts 124 to shield the differential pairs from one another. In an exemplary embodiment, the shield structure 126 is electrically connected to the header assembly 104 and/or the circuit board 106. For example, the shield structure 126 may be electrically connected to the header assembly 104 by extensions (e.g. beams, clips or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The columns of receptacle signal contacts 124 are all held in a common contact module 122. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 262 (shown in FIG. 3) and grounding fingers 326, 356, 386 (shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144. The front housing 120 holds a plurality of rib clips 300, 302, 304 (shown in FIG. 2) that electrically connect the header shields 146 and the shielding features of the contact modules 122.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108. In an alternative embodiment, the header assembly may be a cable mounted header assembly with individual cable mounted header connectors (e.g. signal contacts and header shields), which are held in a common header housing.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
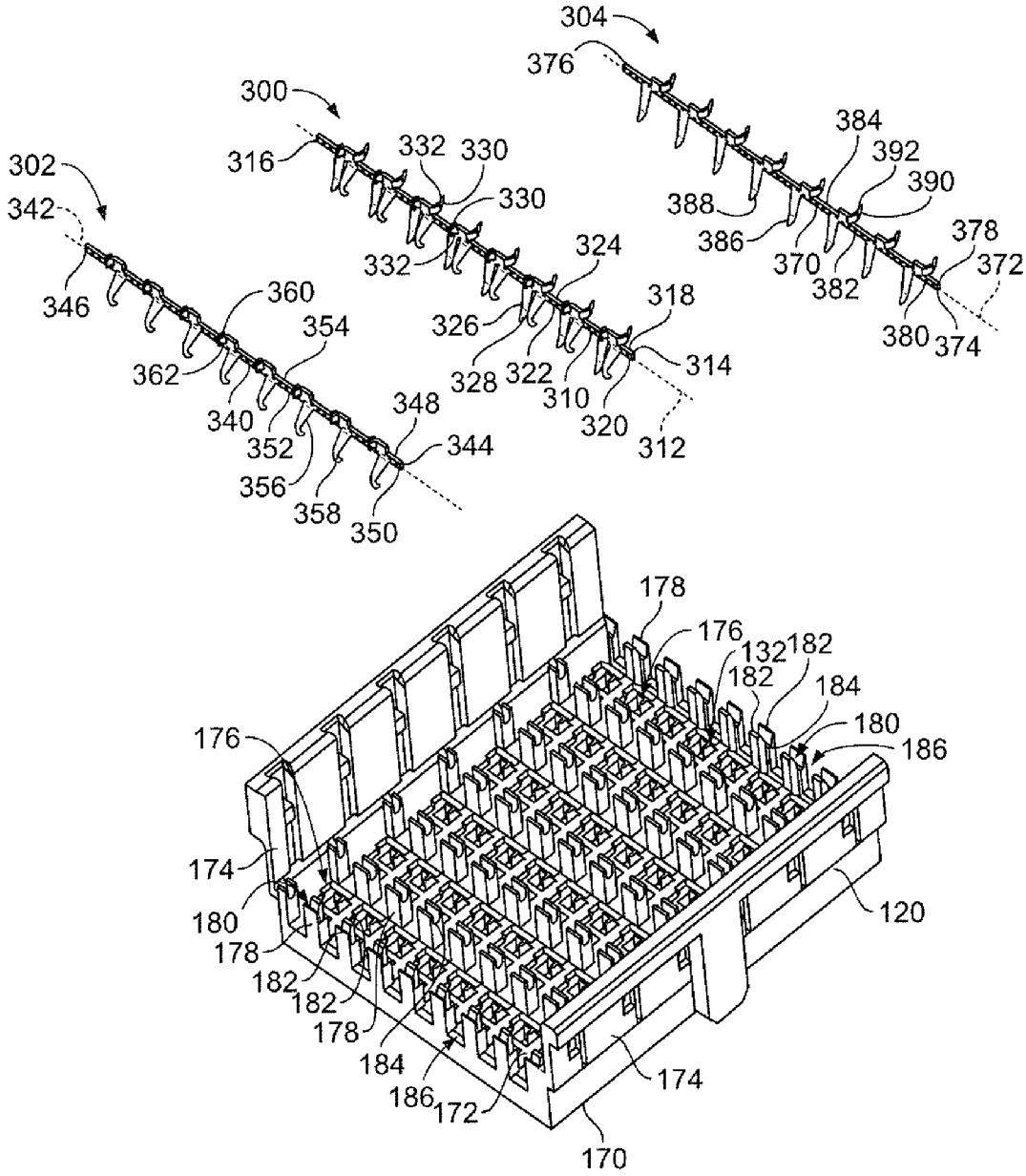
FIG. 2 is an exploded rear view of a portion of the receptacle assembly shown in FIG. 1, showing a front housing and rib clips thereof.
Figure 3:
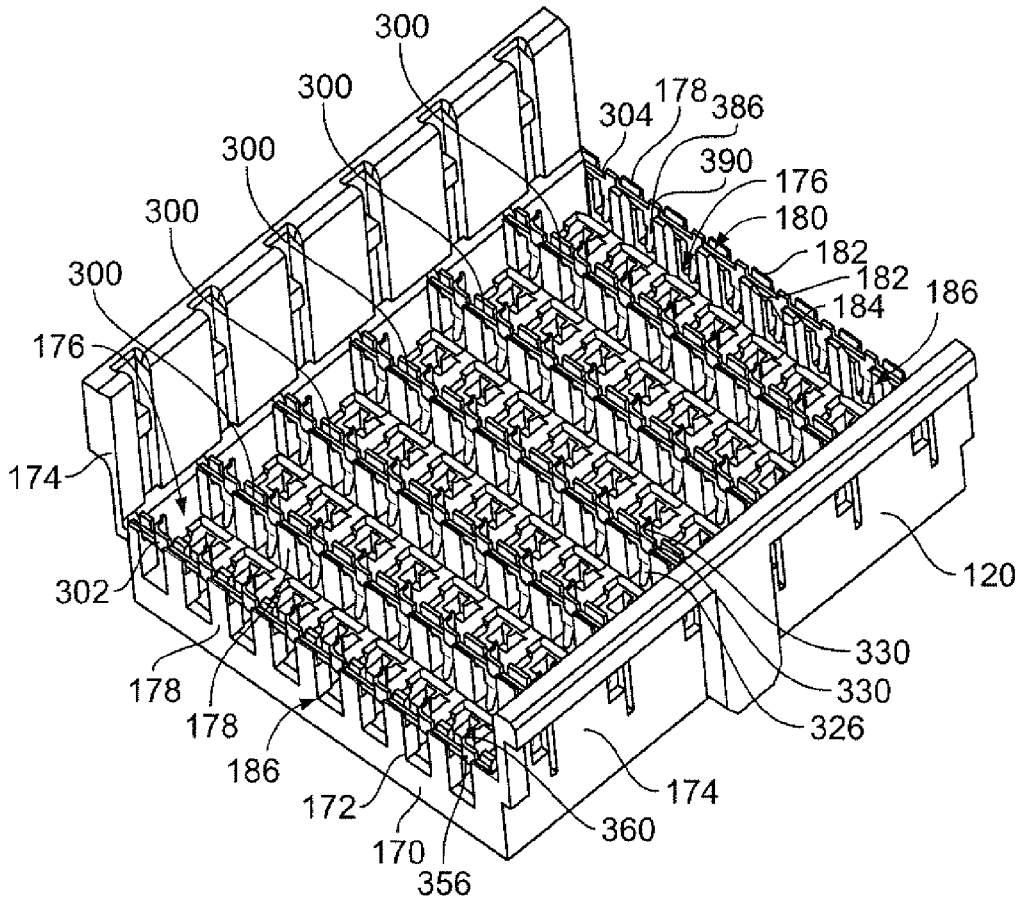
FIG. 3 is an assembled view of the front housing and rib clips shown in FIG. 2.

FIG. 2 is an exploded rear view of the front housing 120 and rib clips 300, 302, 304. FIG. 3 is an assembled view of the front housing 120 with the rib clips 300, 302, 304 loaded therein. The rib clip 300 represents a mid-rib clip that is configured to be positioned at an interior mounting position within the front housing 120. In an exemplary embodiment, a plurality of the mid-rib clips 300 are used, which correspond to the number of contact modules 122 (shown in FIG. 1) used in the receptacle assembly 102 (e.g. one less mid-rib clip 300 than the number of contact modules 122). The rib clips 302, 304 represent left and right outer rib clips, respectively, that are configured to be positioned at outer mounting positions of the front housing 120 (e.g. along the left and right sides of the front housing 120).

The front housing 120 extends between a front 170 and a rear 172. The front housing includes shroud walls 174 extending from the rear 172 at the top and bottom of the front housing 120. The shroud walls 174 are used to support the contact modules 122 when loaded into the front housing 120. The front housing 120 is divided into a plurality of chambers 176 that are separated by clip supports 178 at the rear 172 of the front housing 120. The clip supports 178 may be used to support the contact modules 122 in the chambers 176. The clip supports 178 hold the rib clips 300, 302, 304. Each chamber 176 receives a different contact module 122. The signal contact openings 132 are open to corresponding chambers 176 and pass through the front housing 120 to the front 170.

The clip supports 178 include pockets 180 at distal ends thereof that receive the rib clips 300, 302, 304. The clip supports 178 include tabs 182 on opposite sides of the pockets 180 that engage and/or hold the rib clips 300, 302, 304. The clip supports 178 include support surfaces 184 that support the rib clips 300, 302, 304.

In an exemplary embodiment, finger slots 186 are provided between clip supports 178. The fingers slots 186 are configured to receive grounding fingers 326, 356 or 386 of the rib clips 300, 302, 304. The grounding fingers 326, 356 or 386 are movable within the finger slots 186 to allow for deflection of the grounding fingers 326, 356 or 386 when the grounding fingers 326, 356 or 386 are mated to the header shields 146 (shown in FIG. 1). The grounding fingers 326 of the mid-rib clips 300 are configured to engage header shields on both the right side of the column of clip supports 178 and on the left side of the column of clip supports 178.

During assembly, the mid-rib clips 300 are received in the pockets 180 of the middle columns of clip supports 178 and are supported by the support surfaces 184 and/or tabs 182 of the middle columns of clip supports 178. The left outer rib clip 302 is received in the pockets 180 of the outer column of clip supports 178 along the left side of the front housing 120. The left outer rib clip 302 is supported by the support surfaces 184 and/or tabs 182 of the outer column of clip supports 178 along the left side of the front housing 120. The right outer rib clip 304 is received in the pockets 180 of the outer column of clip supports 178 along the right side of the front housing 120. The right outer rib clip 304 is supported by the support surfaces 184 and/or tabs 182 of the outer column of clip supports 178 along the right side of the front housing 120.

Each mid-rib clip 300 includes a main body 310 extending along a longitudinal axis 312 between a first end 314 and a second end 316. The main body 310 is generally planar and includes a first side 318 and a second side 320 opposite the first side 318. The main body 310 extends between a front 322 and a rear 324. The rib clip 300 is manufactured from a conductive material, such as copper. In an exemplary embodiment, the rib clip 300 is stamped and formed.

The mid-rib clip 300 includes a plurality of grounding fingers 326 extending from the main body 310. The grounding fingers 326 are configured to engage corresponding header shields 146 (shown in FIG. 1) when the receptacle assembly 102 is coupled to the header assembly 104 (both shown in FIG. 1). In the illustrated embodiment, the grounding fingers 326 extend generally forward from the front 322. The grounding fingers 326 are longitudinally offset from one another along the front 322.

In an exemplary embodiment, the grounding fingers 326 are angled out of the plane defined by the main body 310. The grounding fingers 326 may be angled in different directions such that mating interfaces 328 of a first subset of grounding fingers 326 are positioned on one side of the rib clip 300 while the mating interfaces 328 of a second subset of grounding fingers 326 are positioned on the opposite side of the rib clip 300. The first subset of grounding fingers 326 are configured to engage header shields 146 in one column, while the second subset of grounding fingers 326 are configured to engage header shields 146 in a different column. The main body 310 is configured to be positioned between two columns of header shields 146 such that the grounding fingers 326 engage the header shields 146 in both columns.

In an exemplary embodiment, the grounding fingers 326 are arranged in pairs, where the grounding fingers 326 within a pair are longitudinally spaced closer to one another than to grounding fingers 326 of another pair. Each pair of grounding fingers 326 includes one grounding finger 326 from the first subset of grounding fingers 326 and one grounding finger 326 from the second subset of grounding fingers 326. The grounding fingers 326 within each pair extend in different directions and are configured to engage header shields 146 in different columns. Each pair of grounding fingers 326 is configured to be received in a respective finger slot 186. The mating interfaces 328 are exposed within corresponding chambers 176 on either side of the finger slot 186 to engage the header shields 146 when the receptacle assembly 102 is coupled to the header assembly 104. The grounding fingers 326 are deflectable within the finger slots 186. The grounding fingers 326 are offset with respect to one another to allow clearance for both grounding fingers 326 of each pair to deflect into the finger slot 186 without interfering with one another.

The rib clip 300 includes a plurality of mounting tabs 330 extending from the main body 310. The mounting tabs 330 are configured to engage corresponding contact modules 122 (shown in FIG. 1) when the contact modules 122 are loaded into the front housing 120. In an exemplary embodiment, each mounting tab 330 includes one or more projections 332 extending therefrom. The projections 332 are configured to engage the contact module 122 to mechanically and/or electrically connect the rib clip 300 to the contact module 122. Optionally, the projections 332 may engage the contact module 122 in an interference fit. In the illustrated embodiment, the mounting tabs 330 extend generally rearward from the rear 324. The mounting tabs 330 are longitudinally offset from one another along the rear 324.

In an exemplary embodiment, the mounting tabs 330 are bent out of the plane defined by the main body 310. Optionally, the mounting tabs 330 may be bent approximately 90° with respect to the main body 310. The mounting tabs 330 may be bent in different directions such that a first subset of the mounting tabs 330 are positioned on one side of the rib clip 300 while a second subset of the mounting tabs 330 are positioned on the opposite side of the rib clip 300. The first subset of mounting tabs 330 are configured to engage one contact module 122, while the second subset of mounting tabs 330 are configured to engage a different contact module 122. The main body 310 is configured to be positioned on the clip supports 178 between two chambers 176 such that the mounting tabs 330 engage corresponding contact modules 122 received in the chambers 176 on both sides of the clip supports 178.

In an exemplary embodiment, the mounting tabs 330 are arranged in pairs, where the mounting tabs 330 within a pair are longitudinally spaced closer to one another than to mounting tabs 330 of another pair. Each pair of mounting tabs 330 includes one mounting tab 330 from the first subset of mounting tabs 330 and one mounting tab 330 from the second subset of mounting tabs 330. The mounting tabs 330 within each pair extend in respective different directions and are configured to engage respective different contact modules 122.

The left outer rib clip 302 includes a main body 340 extending along a longitudinal axis 342 between a first end 344 and a second end 346. The main body 340 is generally planar and includes a first side 348 and a second side 350 opposite the first side 348. The main body 340 extends between a front 352 and a rear 354. The left outer rib clip 302 is manufactured from a conductive material, such as copper. In an exemplary embodiment, the rib clip 302 is stamped and formed.

The left outer rib clip 302 includes a plurality of grounding fingers 356 extending from the main body 340. The grounding fingers 356 are configured to engage corresponding header shields 146 (shown in FIG. 1) when the receptacle assembly 102 is coupled to the header assembly 104 (both shown in FIG. 1). In the illustrated embodiment, the grounding fingers 356 extend generally forward from the front 352. The grounding fingers 356 are longitudinally offset from one another along the front 352. The grounding fingers 356 are angled out of the plane defined by the main body 340. The grounding fingers 356 are angled in a common direction such that the grounding fingers 356 are on the first side 348 of the main body 340.

The left outer rib clip 302 includes a plurality of mounting tabs 360 extending from the main body 340. The mounting tabs 360 are configured to engage the outermost contact module 122 when such contact module 122 is loaded into the front housing 120. In an exemplary embodiment, each mounting tab 360 includes one or more projections 362 extending therefrom. The projections 362 are configured to engage the contact module 122 to mechanically and/or electrically connect the rib clip 302 to the contact module 122. In the illustrated embodiment, the mounting tabs 360 extend generally rearward from the rear 354. The mounting tabs 360 are longitudinally offset from one another along the rear 354. In an exemplary embodiment, the mounting tabs 360 are bent out of the plane defined by the main body 340. Optionally, the mounting tabs 360 may be bent approximately 90° with respect to the main body 340. The mounting tabs 360 are bent in a common direction such that the mounting tabs 360 are on the first side 348 of the main body 340.

The right outer rib clip 304 includes a main body 370 extending along a longitudinal axis 372 between a first end 374 and a second end 376. The main body 370 is generally planar and includes a first side 378 and a second side 380 opposite the first side 378. The main body 370 extends between a front 382 and a rear 384. The right outer rib clip 304 is manufactured from a conductive material, such as copper. In an exemplary embodiment, the rib clip 304 is stamped and formed.

The right outer rib clip 304 includes a plurality of grounding fingers 386 extending from the main body 370. The grounding fingers 386 are configured to engage corresponding header shields 146 (shown in FIG. 1) when the receptacle assembly 102 is coupled to the header assembly 104 (both shown in FIG. 1). In the illustrated embodiment, the grounding fingers 386 extend generally forward from the front 382. The grounding fingers 386 are longitudinally offset from one another along the front 382. The grounding fingers 386 are angled out of the plane defined by the main body 370. The grounding fingers 386 are angled in a common direction such that the grounding fingers 386 are on the second side 380 of the main body 370.

The right outer rib clip 304 includes a plurality of mounting tabs 390 extending from the main body 370. The mounting tabs 390 are configured to engage the outermost contact module 122 when such contact module 122 is loaded into the front housing 120. In an exemplary embodiment, each mounting tab 390 includes one or more projections 392 extending therefrom. The projections 392 are configured to engage the contact module 122 to mechanically and/or electrically connect the rib clip 304 to the contact module 122. In the illustrated embodiment, the mounting tabs 390 extend generally rearward from the rear 384. The mounting tabs 390 are longitudinally offset from one another along the rear 384. In an exemplary embodiment, the mounting tabs 390 are bent out of the plane defined by the main body 370. Optionally, the mounting tabs 390 may be bent approximately 90° with respect to the main body 370. The mounting tabs 390 are bent in a common direction such that the mounting tabs 390 are on the second side 380 of the main body 370.

Figure 4:
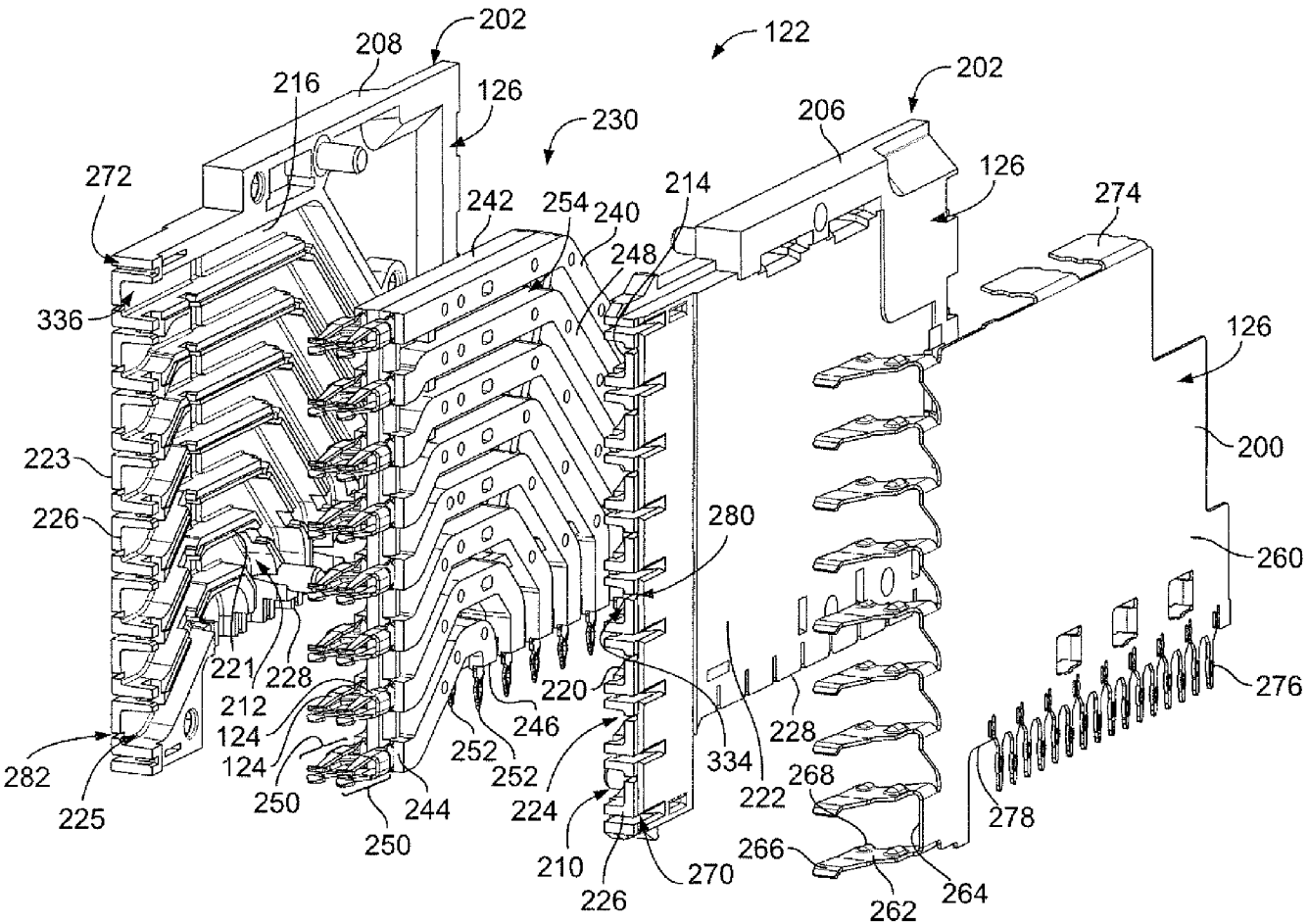
FIG. 4 is an exploded view of a contact module for the receptacle assembly shown in FIG. 1.

FIG. 4 is an exploded view of one of the contact modules 122 and part of the shield structure 126. The shield structure 126 includes a ground shield 200 and a conductive holder 202. In an exemplary embodiment, the rib clips 300, 302, 304 (shown in FIG. 2) may be coupled to the contact modules 122 and form part of the shield structure 126. The conductive holder 202 is configured to be electrically coupled to the rib clips 300, 302, 304 to electrically connect the contact module 122 to the header shields 146 (shown in FIG. 1). The ground shield 200 is also configured to directly engage the header shields 146 to electrically connect the contact module 122 to the header shields 146. The ground shield 200 and rib clips 300, 302, 304 provide multiple, redundant points of contact to each header shield 146.

The contact module 122 includes the conductive holder 202, which in the illustrated embodiment includes a first holder member 206 and a second holder member 208 that are coupled together to form the holder 202. The holder members 206, 208 are fabricated from a conductive material. For example, the holder members 206, 208 may be die-cast from a metal material. Alternatively, the holder members 206, 208 may be stamped and formed or may be fabricated from a plastic material that has been metalized or coated with a metallic layer. By having the holder members 206, 208 fabricated from a conductive material, the holder members 206, 208 may provide electrical shielding for the receptacle assembly 102. When the holder members 206, 208 are coupled together, the holder members 206, 208 define at least a portion of the shield structure 126 of the receptacle assembly 102.

The holder members 206, 208 include chambers 210, 212 that together define a common chamber of the conductive holder 202. The common chamber receives a frame assembly 230, which includes the receptacle signal contacts 124, therein. The holder members 206, 208 provide shielding around the frame assembly 230 and receptacle signal contacts 124.

The holder members 206, 208 include tabs 220, 221 extending inward from side walls 222, 223 thereof. The tabs 220 extend into the chamber 210 and divide the chamber 210 into discrete channels 224. The tabs 221 extend into the chamber 212 and divide the chamber 212 into discrete channels 225. The tabs 220, 221 define at least a portion of the shield structure 126 of the receptacle assembly 102. The tabs 220, 221 provide shielding between the channels 224 and the channels 225, respectively. When assembled, the holder members 206, 208 are coupled together and the channels 224, 225 are aligned to form common channels that are completely surrounded by the conductive material of the holder members 206, 208 (e.g. the side walls 222, 223 and tabs 220, 221), thus providing 360° shielding for the receptacle signal contacts 124 received therein. When assembled, the holder members 206, 208 define a front 226 and a bottom 228 of the conductive holder 202.

The contact module 122 includes the frame assembly 230, which is held by the conductive holder 202. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the dielectric frames 240, 242 other than overmolding a lead frame, such as loading receptacle signal contacts 124 into a formed dielectric body.

The dielectric frames 240, 242 are substantially similar to one another and only the dielectric frame 240 will be described in detail. The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 202 and the contact tails 252 extend downward from the bottom 228 of the holder 202.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the dielectric frame 240 and corresponding receptacle signal contacts 124 are loaded into the chamber 210 and are coupled to the holder member 206. The frame members 248 are received in corresponding channels 224. The tabs 220 are received in corresponding windows 254 such that the tabs 220 are positioned between adjacent receptacle signal contacts 124. The dielectric frame 242 and corresponding receptacle signal contacts 124 are loaded into the chamber 212 and are coupled to the holder member 208 in a similar manner, with the tabs 221 extending through the dielectric frame 242.

The holder members 206, 208, which are part of the shield structure 126, provide electrical shielding between and around respective receptacle signal contacts 124. The holder members 206, 208 provide shielding from electromagnetic interference (EMI) and/or radio frequency interference (RFI). The holder members 206, 208 may provide shielding from other types of interference as well. The holder members 206, 208 provide electrical shielding around the outside of the frames 240, 242, and thus around the outside of all of the receptacle signal contacts 124, as well as between the receptacle signal contacts 124, such as between pairs of receptacle signal contacts 124, using the tabs 220, 221. The holder members 206, 208 control electrical characteristics, such as impedance control, cross-talk control, and the like, of the receptacle signal contacts 124.

The ground shield 200 includes a main body 260. In the illustrated embodiment, the main body 260 is generally planar. The ground shield 200 includes grounding beams 262 extending forward from a front 264 of the main body 260. In an exemplary embodiment, the grounding beams 262 are bent out of plane with respect to the main body 260 such that the grounding beams 262 are oriented perpendicular with respect to the plane defined by the main body 260. In an exemplary embodiment, the ground shield 200 is manufactured from a metal material. The ground shield 200 is a stamped and formed part with the grounding beams 262 being stamped and then bent during the forming process out of plane with respect to the main body 260. Optionally, the main body 260 may extend vertically while the grounding beams 262 may extend horizontally, however other orientations are possible in alternative embodiments.

The grounding beams 262 extend forward from the front 226 of the holder 202 such that the grounding beams 262 may be loaded into the front housing 120 (shown in FIG. 1). Each grounding beam 262 has a mating interface 266 at a distal end thereof. The mating interface 266 is configured to engage the corresponding header shield 146. The grounding beam 262 includes one or more projections 268 extending therefrom. The projections 268 are configured to engage the conductive holder 202 when the ground shield 200 is coupled thereto.

In an exemplary embodiment, the holder members 206, 208 include slots 270, 272, respectively, that receive the grounding beams 262 therein when the ground shield 200 is coupled to the side wall 222 of the holder member 206. The projections 268 are received in the slots 270, 272 and engage the holder members 206, 208 to create an electrical connection with the holder members 206, 208. When the grounding beams 262 are received in the slots 270, 272, the grounding beams 262 are vertically offset with respect to the receptacle signal contacts 124. For example, the grounding beams 262 may be positioned above and/or below corresponding receptacle signal contacts 124. In an exemplary embodiment, the grounding beams 262 are generally aligned with the receptacle signal contacts 124 of both dielectric frames 240, 242. The grounding beams 262 provide electrical shielding between one row of receptacle signal contacts 124 and another row of receptacle signal contacts 124 that is either above or below the one row of receptacle signal contacts 124. The grounding beams 262 are wide enough to generally cover both columns of receptacle signal contacts 124 to provide shielding for the receptacle signal contacts 124 of both columns. The grounding beams 262 may include a two-pronged beam, with one prong aligned with the receptacle signal contacts 124 of the dielectric frame 240 and the other prong aligned with the receptacle signal contacts 124 of the dielectric frame 242.

The ground shield 200 includes a plurality of mounting tabs 274 extending inward from the main body 260. The mounting tabs 274 are configured to be coupled to the holder member 206. The mounting tabs 274 secure the ground shield 200 to the first side wall 222. The mounting tabs 274 engage the holder member 206 to electrically connect the ground shield 200 to the holder member 206. Any number of mounting tabs 274 may be provided. The location of the mounting tabs 274 may be selected to secure various portions of the ground shield 200, such as the top, the back, the front, the bottom, and the like of the ground shield 200 to the holder member 206. The engagement of the projections 268 with the holder 202 help to secure the ground shield 200 to the holder 202. Optionally, the ground shield 200 may engage the holder member 208 in addition to, or in alternative to, the holder member 206.

The ground shield 200 includes a plurality of ground pins 276 extending from a bottom 278 of the ground shield 200. The ground pins 276 are configured to be terminated to the circuit board 106 (shown in FIG. 1). The ground pins 276 may be compliant pins, such as eye-of-the-needle pins, that are throughhole mounted to plated vias in the circuit board 106. Other types of termination means or features may be provided in alternative embodiments to couple the ground shield 200 to the circuit board 106.

In an exemplary embodiment, the holder members 206, 208 include rib clip slots 280, 282, respectively, that receive the mounting tabs 330, 360 and/or 390 therein when the rib clips 300, 302 and/or 304 are coupled to the contact module 122. The projections 332, 362 and/or 392 are received in the rib clip slots 280, 282 and engage the holder members 206, 208 to create an electrical connection with the holder members 206, 208. When the mounting tabs 330, 360 and/or 390 are received in the rib clip slots 280, 282, the projections 332, 362 and/or 392 engage the holder members 206, 208 by an interference fit. In an exemplary embodiment, the rib clip slots 280, 282 are vertically offset with respect to one another to receive corresponding mounting tabs 330, 360 and/or 390, which may be at different vertical positions.

Figure 5:
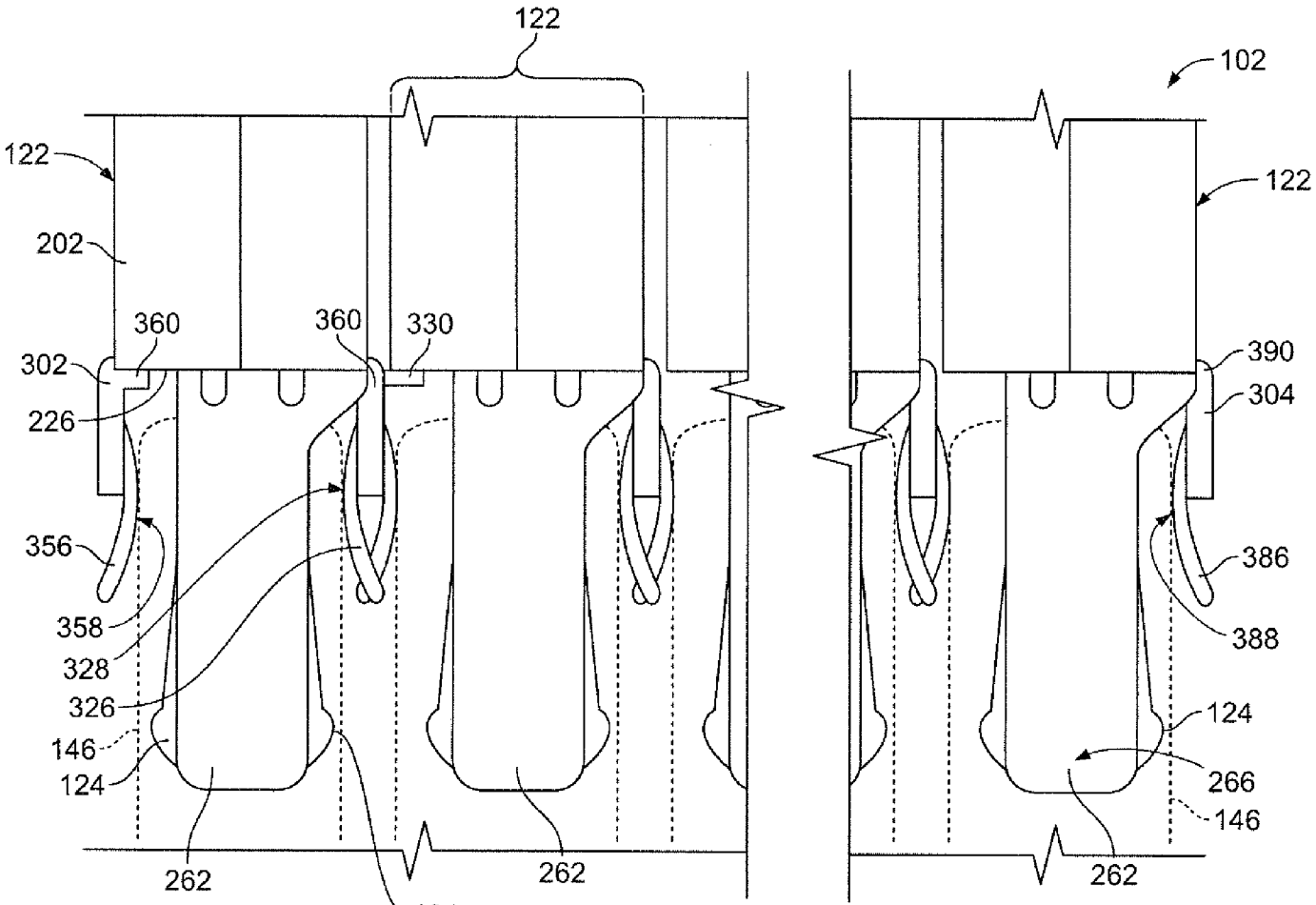
FIG. 5 is a top view of the contact module shown in FIG. 4.

FIG. 5 is a top view of a portion of the receptacle assembly 102, showing the rib clips 300, 302, 304 connected to the contact modules 122. The front housing 120 (shown in FIG. 1) is removed for clarity. Optionally, the rib clips 300, 302, 304 and contact modules 122 may be pre-assembled and loaded into the front housing 120 as a unit rather than preloading the rib clips 300, 302, 304 into the front housing 120.

The mounting tabs 330, 360, 390 of the rib clips 300, 302, 304 are loaded into corresponding contact modules 122 to electrically connect the rib clips 300, 302, 304 to the conductive holders 202 of the contact modules 122. The mid-rib clips 300 are positioned along the interface between two contact modules 122 and the mounting tabs 330 are terminated to the conductive holders 202 of both contact modules 122. The left outer rib clip 302 is terminated to the left outer-most contact module 122. The right outer rib clip 304 is terminated to the right outer-most contact module 122.

The grounding fingers 326, 356, 386 of the rib clips 300, 302, 304 extend along the receptacle signal contacts 124 and are configured to be directly electrically connected to corresponding header shields 146 (shown in phantom) to electrically connect the rib clips 300, 302, 304 to the header shields 146. The grounding fingers 326 of the mid-rib clips 300 extend in two directions to engage header shields on both sides of the mid-rib clips 300. The grounding fingers 356 of the left outer rib clip 302 are terminated to header shields 146 that surround the receptacle signal contacts 124 of the left outer-most contact module 122. The grounding fingers 386 of the right outer rib clip 304 are terminated to header shields 146 that surround the receptacle signal contacts 124 of the right outer-most contact module 122.

The differential pairs of receptacle signal contacts 124 are arranged side-by-side and extend forward from the front 226 of the conductive holder 202. The grounding beam 262 extends over the top of the corresponding pair of receptacle signal contacts 124. The rib clips 300, 302, 304 are arranged along the sides of the pair of receptacle signal contacts 124. The rib clips 300, 302, 304 define a direct ground path from the header shields 146 to the conductive holders 202. In an exemplary embodiment, the grounding fingers 326, 356, 386 of the rib clips 300, 302, 304 are shorter than the grounding beams 262 such that the mating interfaces 328, 358, 388 are positioned closer to the fronts 226 of the conductive holders 202 than the mating interfaces 266 of the grounding beams 262.

Figure 6:
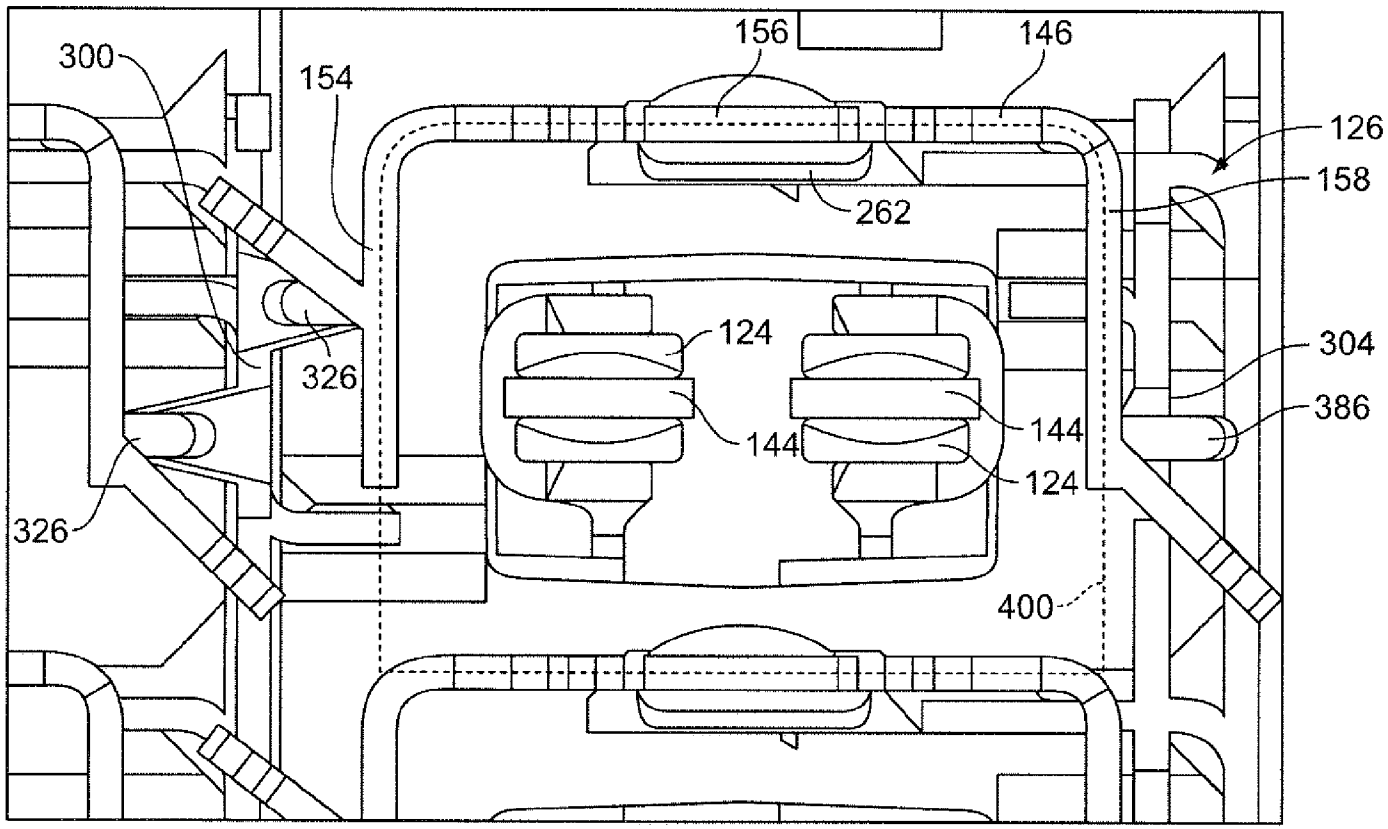
FIG. 6 is a front view of a portion of the electrical connector system shown in FIG. 1.

FIG. 6 is a front view of a portion of the electrical connector system 100, showing grounding beams 262 and grounding fingers 326, 386 of the rib clips 300, 304 engaging corresponding header shields 146. The front housing 120 (shown in FIG. 1) and the header housing 138 (shown in FIG. 1) are removed for clarity.

The header signal contacts 144 are mated to the receptacle signal contacts 124. The header shield 146 is C-shaped and surrounds the header signal contacts 144 and receptacle signal contacts 124 on the top and both sides. Another header shield 146 below the header signal contacts 144 and receptacle signal contacts 124 extends across the bottom thereof to create a shielded mating zone 400. The shielded mating zone 400 is peripherally surrounded on all four sides thereof. In the illustrated embodiment, the grounding beam 262 engages an interior surface of the header shield 146 at the top wall 156, while the grounding fingers 326, 386 engage exterior surfaces of the side walls 154, 158.

The shield structure 126 has multiple, redundant points of contact with the C-shaped header shield 146. For example, three points of contact with each header shield 146 are defined by the grounding fingers 326, 386 and the grounding beam 262. The electrical performance of the electrical connector system 100 is enhanced with multiple ground contact points to the C-shaped header shield 146, as compared to systems that have a single ground contact point.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a contact module including a conductive holder and a frame assembly received in the conductive holder, the frame assembly comprising a plurality of contacts and a dielectric frame supporting the contacts, the dielectric frame being disposed between the conductive holder and the contacts, the contacts extending from the conductive holder for electrical termination;

a front housing configured for mating with a header assembly, the front housing receiving the contact module therein, the front housing having a plurality of clip supports at a rear of the front housing; and a rib clip held by the clip supports, the rib clip having a plurality of grounding fingers extending therefrom being configured to engage corresponding header shields of the header assembly, the rib clip including a plurality of mounting tabs extending therefrom, the mounting tabs engaging the conductive holder to electrically connect the rib clip to the conductive holder.

2. The receptacle assembly of claim 1, wherein the conductive holder includes a plurality of slots receiving corresponding mounting tabs.

3. The receptacle assembly of claim 1, further comprising a plurality of contact modules received in the front housing and further comprising a plurality of rib clips held by the clip supports, each rib clip engaging at least one contact module.

4. The receptacle assembly of claim 1, further comprising a second contact module received in the front housing, the mounting tabs of the rib clip engaging the contact module and the second contact module.

5. The receptacle assembly of claim 1, wherein the rib clip includes a main body extending between a front and a rear, the main body being elongated along a longitudinal axis, the grounding fingers extending from the front and being longitudinally offset from one another, the mounting tabs extending from the rear and being longitudinally offset from one another.

6. The receptacle assembly of claim 1, wherein the front housing includes a first chamber receiving the contact module, the front housing includes a second chamber receiving a second contact module, the clip supports being positioned between the first and second chambers, the rib clip being positioned between the first and second chamber with a first subset of grounding fingers being exposed in the first chamber and a second subset of grounding fingers being exposed in the second chamber.

7. The receptacle assembly of claim 1, wherein the grounding fingers are configured to engage different header shields.

8. The receptacle assembly of claim 1, wherein the rib clip includes a main body being generally planar and extending between a front and a rear, the main body being elongated along a longitudinal axis, the grounding fingers extending from the front, the mounting tabs extending from the rear, the main body having a first side and a second side, wherein a plurality of the grounding fingers extend from the front out of a plane defined by the main body in a first direction such that mating interfaces of such grounding fingers are located on the first side, and wherein a plurality of the grounding fingers extend from the front out of the plane defined by the main body in a second direction such that mating interfaces of such grounding fingers are positioned on the second side.

9. A receptacle assembly comprising:

a first contact module including a conductive holder and a frame assembly received in the conductive holder, the frame assembly of the first contact module comprising a plurality of contacts and a dielectric frame supporting the contacts, the contacts extending from the conductive holder of the first contact module for electrical termination;

a second contact module including a conductive holder and a frame assembly received in the conductive holder, the frame assembly of the second contact module comprising a plurality of contacts and a dielectric frame supporting the contacts, the contacts extending from the conductive holder of the second contact module for electrical termination;

a front housing configured for mating with a header assembly, the front housing receiving the first and second contact modules therein with the first and second contact modules being arranged in a stacked configuration in the front housing, the front housing having a plurality of clip supports at a rear of the front housing; and a rib clip held by the clip supports, the rib clip having a plurality of grounding fingers extending therefrom being configured to engage corresponding header shields of the header assembly, the rib clip including a plurality of mounting tabs extending therefrom, a first subset of the mounting tabs engaging the conductive holder of the first contact module to electrically connect the rib clip to the conductive holder of the first contact module, a second subset of the mounting tabs engaging the conductive holder of the second contact module to electrically connect the rib clip to the conductive holder of the second contact module.

10. The receptacle assembly of claim 9, wherein the conductive holders of the first and second contact modules include a plurality of slots receiving corresponding mounting tabs.

11. The receptacle assembly of claim 9, further comprising a plurality of rib clips held by the clip supports, each rib clip engaging at least one contact module.

12. The receptacle assembly of claim 9, wherein the rib clip includes a main body extending between a front and a rear, the main body being elongated along a longitudinal axis, the grounding fingers extending from the front and being longitudinally offset from one another, the mounting tabs extending from the rear and being longitudinally offset from one another.

13. The receptacle assembly of claim 9, wherein the front housing includes a first chamber receiving the first contact module and a second chamber receiving the second contact module, the clip supports being positioned between the first and second chambers, the rib clip being positioned between the first and second chambers with a first subset of grounding fingers being exposed in the first chamber and a second subset of grounding fingers being exposed in the second chamber.

14. The receptacle assembly of claim 9, wherein the grounding fingers are configured to engage different header shields.

15. The receptacle assembly of claim 9, wherein the rib clip includes a main body being generally planar and extending between a front and a rear, the main body being elongated along a longitudinal axis, the grounding fingers extending from the front, the mounting tabs extending from the rear, the main body having a first side and a second side, wherein the first subset of mounting tabs extend from the rear out of a plane defined by the main body in a first direction such that mating interfaces of such mounting tabs are located on the first side, and wherein the second subset of mounting tabs extend from the rear out of the plane defined by the main body in a second direction such that mating interfaces of such mounting tabs are positioned on the second side.

16. An electrical connector assembly comprising:

a header assembly comprising a header housing, a plurality of header contacts held by the header housing, and a plurality of C-shaped header shields surrounding corresponding header contacts, the header shields having walls defining the C-shaped header shields; and a receptacle assembly matable to the header assembly, the receptacle assembly comprising:

a first contact module including a conductive holder and a frame assembly received in the conductive holder, the frame assembly of the first contact module comprising a plurality of contacts and a dielectric frame supporting the contacts, the contacts extending from the conductive holder of the first contact module for electrical termination;

a second contact module including a conductive holder and a frame assembly received in the conductive holder, the frame assembly of the second contact module comprising a plurality of contacts and a dielectric frame supporting the contacts, the contacts extending from the conductive holder of the second contact module for electrical termination;

a front housing configured for mating with the header housing, the front housing receiving the first and second contact modules therein with the first and second contact modules being arranged in a stacked configuration in the front housing, the front housing having a plurality of clip supports at a rear of the front housing; and a rib clip held by the clip supports, the rib clip having a plurality of grounding fingers extending therefrom being configured to engage corresponding header shields of the header assembly, the rib clip including a plurality of mounting tabs extending therefrom, a first subset of the mounting tabs engaging the conductive holder of the first contact module to electrically connect the rib clip to the conductive holder of the first contact module, a second subset of the mounting tabs engaging the conductive holder of the second contact module to electrically connect the rib clip to the conductive holder of the second contact module.

17. The electrical connector assembly of claim 16, further comprising a plurality of rib clips held by the clip supports, each rib clip engaging at least one contact module.

18. The electrical connector assembly of claim 16, wherein the rib clip includes a main body extending between a front and a rear, the main body being elongated along a longitudinal axis, the grounding fingers extending from the front and being longitudinally offset from one another, the mounting tabs extending from the rear and being longitudinally offset from one another.

19. The electrical connector assembly of claim 16, wherein the front housing includes a first chamber receiving the first contact module and a second chamber receiving the second contact module, the clip supports being positioned between the first and second chambers, the rib clip being positioned between the first and second chambers with a first subset of grounding fingers being exposed in the first chamber and a second subset of grounding fingers being exposed in the second chamber.

20. The electrical connector assembly of claim 16, wherein the grounding fingers are configured to engage different header shields.

* * * * *